US007862160B2

(12) United States Patent
Andrews et al.

(10) Patent No.: US 7,862,160 B2
(45) Date of Patent: Jan. 4, 2011

(54) HYBRID MANIFOLD FOR AN INK JET PRINTHEAD

(75) Inventors: John R. Andrews, Fairmont, NY (US); Chad J. Slenes, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 949 days.

(21) Appl. No.: 11/693,872

(22) Filed: Mar. 30, 2007

(65) Prior Publication Data

US 2008/0239015 A1 Oct. 2, 2008

(51) Int. Cl.
*B41J 2/045* (2006.01)

(52) U.S. Cl. ..... 347/70

(58) Field of Classification Search ..... 347/71, 347/70, 72, 67, 68–69, 63, 65, 40, 85, 90
See application file for complete search history.

(56) References Cited

U.S. PATENT DOCUMENTS 7,425,052 B2 * 9/2008 Silverbrook ..... 347/40

* cited by examiner

*Primary Examiner*—K. Feggins
(74) *Attorney, Agent, or Firm*—Marger Johnson & McCollom, P.C.

(57) ABSTRACT

A print head has an array of jets to dispense ink onto a printing surface, an array of actuators to cause the jets to dispense ink and an ink manifold to route ink to the array of jets, the ink manifold being formed of at least one polymer layers. A print manifold has an array of jets formed on a metal plate, at least one polymer layer mounted on the metal plate, the polymer layer including an array of manifolds corresponding to the array of jets and an electronic circuit board mounted on the polymer layer, the electronic circuit board having an array of holes corresponding to the array of manifolds. A print system includes at least one ink reservoir at least one umbilical to transport ink out of the ink reservoir and a print head as described above.

19 Claims, 5 Drawing Sheets

HYBRID MANIFOLD FOR AN INK JET PRINTHEAD

BACKGROUND

Ink jet printers generally transfer ink to a printing surface by actuation of some sort of transducer that causes a jet or nozzle to dispense ink, often a drop at a time. The transducer receives some sort of electrical signal and then provides a mechanical impetus to cause ink to exit the jet. For example, in piezoelectric ink jets, a piezoelectric element receives an electric signal and moves, usually pressing against a membrane or other structure to push the ink through the jet. In order to control the printing process, the ink must reach the jets from ink reservoirs.

Transmission of the ink from the reservoir to the jets normally involves pushing, often with air pressure, the ink through some sort of umbilical, pipe or tube into manifold pathways that route the ink to the jets. The ink jet print heads, the structure that actually causes the ink to be printed, includes the manifolds, the jet array and the control circuitry. The jet array and the control circuitry, such as the actuators, may be referred to as the jet stack. The ink fed to the jet stack may travel through several different manifolds to allow better control of the ink flow and to manage air flow from the pressurization of the ink.

In current implementations of ink jet print heads, the print heads generally consist of several steel plates structured in a way to form internal manifolds, the steel plates being brazed or adhered together. These internal manifolds provide an ink supply for multiple nearby jets. The extra jet stack plates needed to form the internal manifolds add cost. The internal manifolds may also result in acoustic resonance that may cause the jets to drop out of operation in certain printing conditions. Further, the plates may also provide increased opportunities for air bubble traps that decrease reliability.

DETAILED DESCRIPTION

Figure 1:
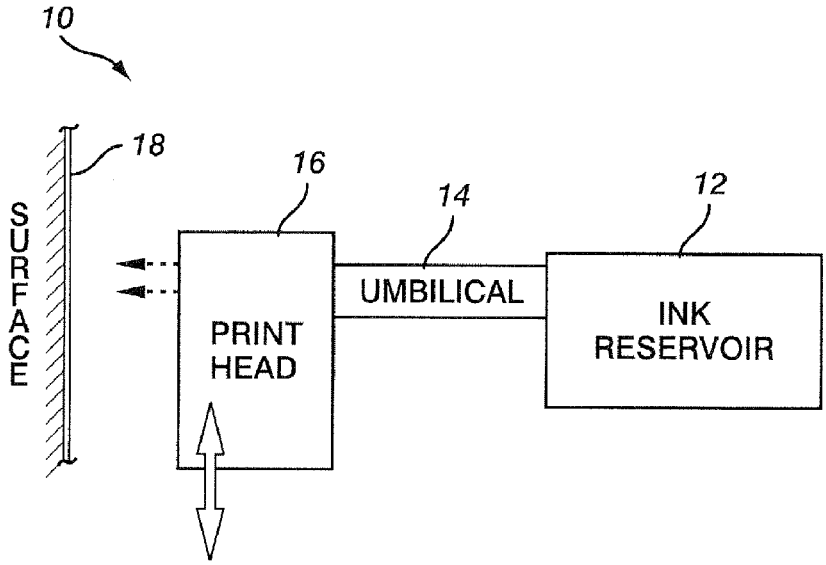
FIG. 1 shows a block diagram of an ink jet printer.

FIG. 1 shows one example of an ink jet printer. It must be noted that all figures show examples for the ease of understanding. No limitation to the scope of the claims is intended nor should it be inferred. The ink jet printer 10 of FIG. 1 has an ink reservoir that may be liquid ink, powdered ink that is subsequently mixed, phase-change inks that are melted and then transported, etc. Umbilical 14 connects the reservoir to the print head 16. The umbilical may be any pathway that allows the ink to move from the ink reservoir to the print head for transfer to the printing surface 18.

The block diagram of FIG. 1 does not show other aspects of ink jet printers, such as paper trays or web fed rolls, control panels, user interfaces, etc. The ink jet printer may be of any type of ink jet device including printers, fax machines, copiers, multi-function peripherals, etc. No limitation to any particular configuration of printer or its functionality is intended nor should it be inferred.

Figure 2:
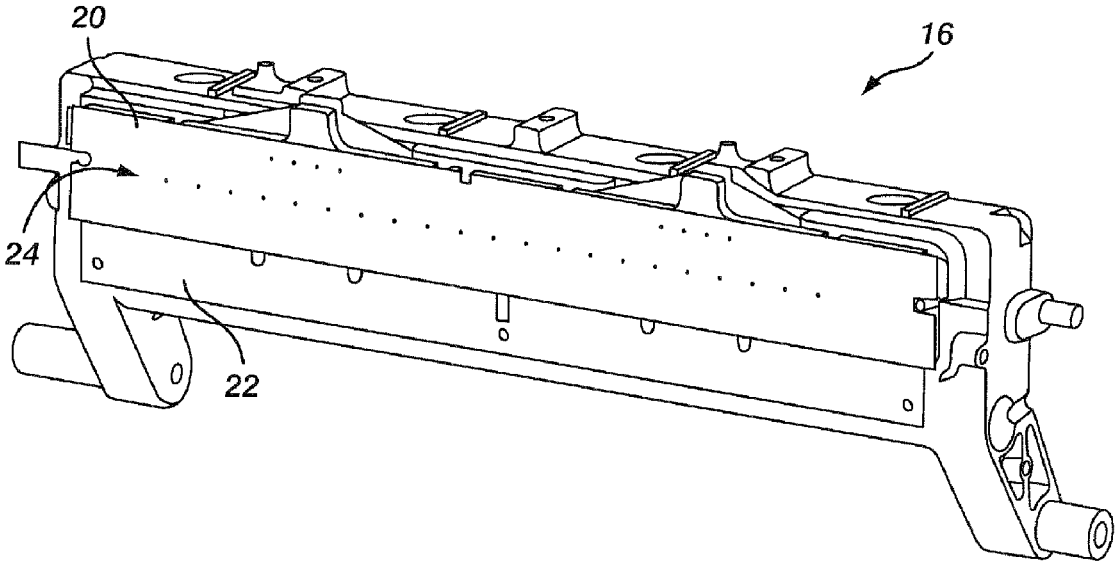
FIG. 2 shows an example of an ink jet print head.

The print head 16 of FIG. 1 may take many forms. FIG. 2 shows a more detailed view of a print head. The print head typically has several parts to the assembly between the umbilical and the jet stack, including print head ink reservoirs for storage of ink drawn from the ink reservoir 12 from FIG. 1. Depending upon the print head architecture, these may or may not be needed. It is possible for the print head to draw ink directly from the ink reservoir 12 of FIG. 1.

Figure 3:
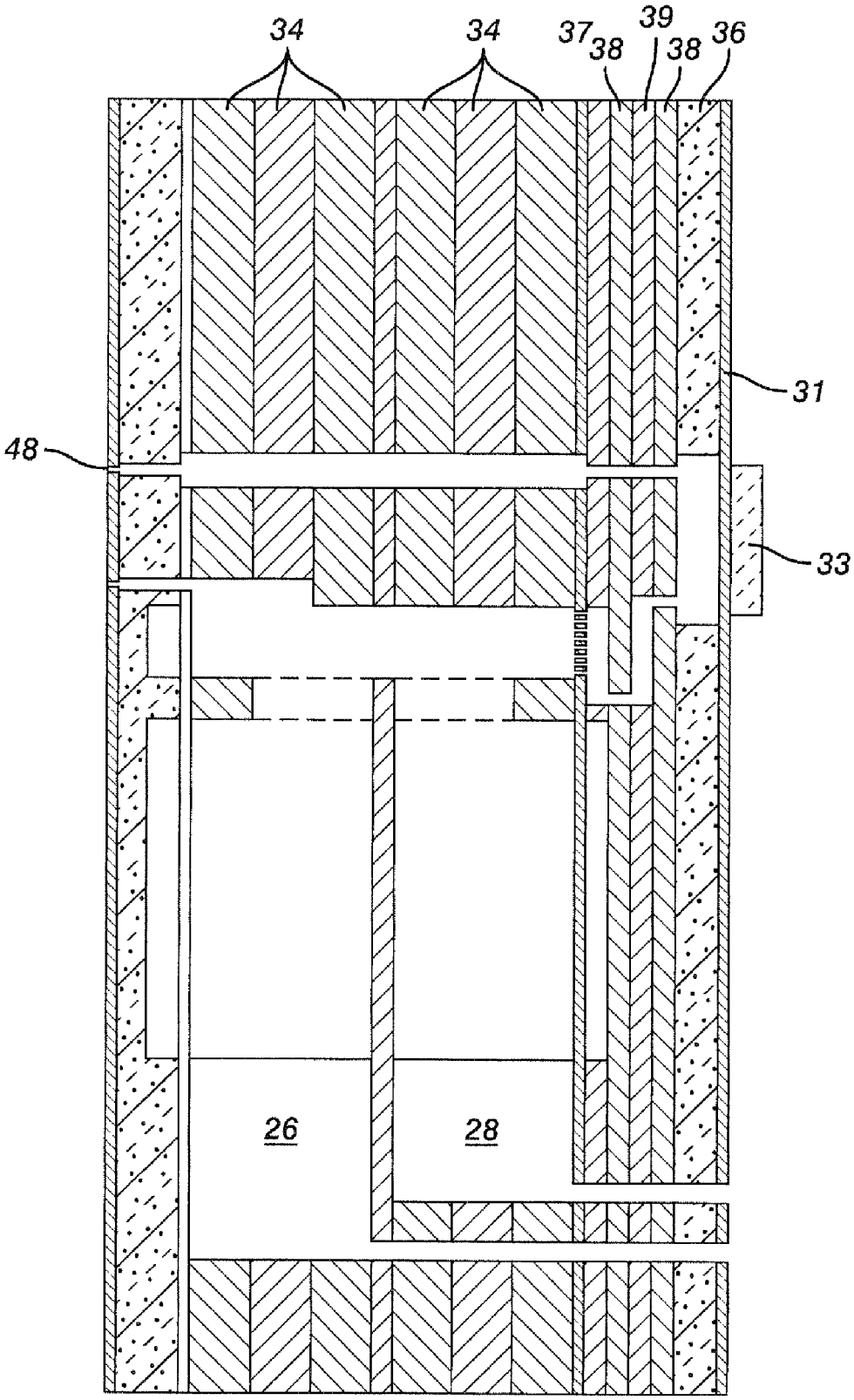
FIG. 3 shows an example of ink flow through a jet stack.

Once the ink has passed through the reservoirs, if provided, it must pass through the electronic circuit board 22, to reach the jet stack 20. The jet stack 20 consists of a series of plates, and an array of jets such as 24. Each jet 24 consists of a body and an aperture, as will be discussed in more detail further. The stack of plates of a jet stack include plates with ink manifolds. Each additional plate adds cost to the print head and may contribute to the print inefficiency issues mentioned previously. FIG. 3 shows example of a current jet stack and manifold plates.

As can be seen in FIG. 3, current print heads have multiple manifold plates 34 and additional structures such as separator plates 38, an inlet 39 and air gap 37. The plates form the ink manifolds 26 and 28. In the example of FIG. 3, manifold 26 provides a path for black and cyan inks and manifold 28 provides a path for yellow and magenta inks. The jet stack will generally include local ink reservoirs to provide ink immediately to the jets. The piezoelectric transducer 33 pushes the diaphragm 31 to force ink out the apertures 48. Elimination of many of these extra plates increases the efficiency of the print head and reduces the cost.

Figure 4:
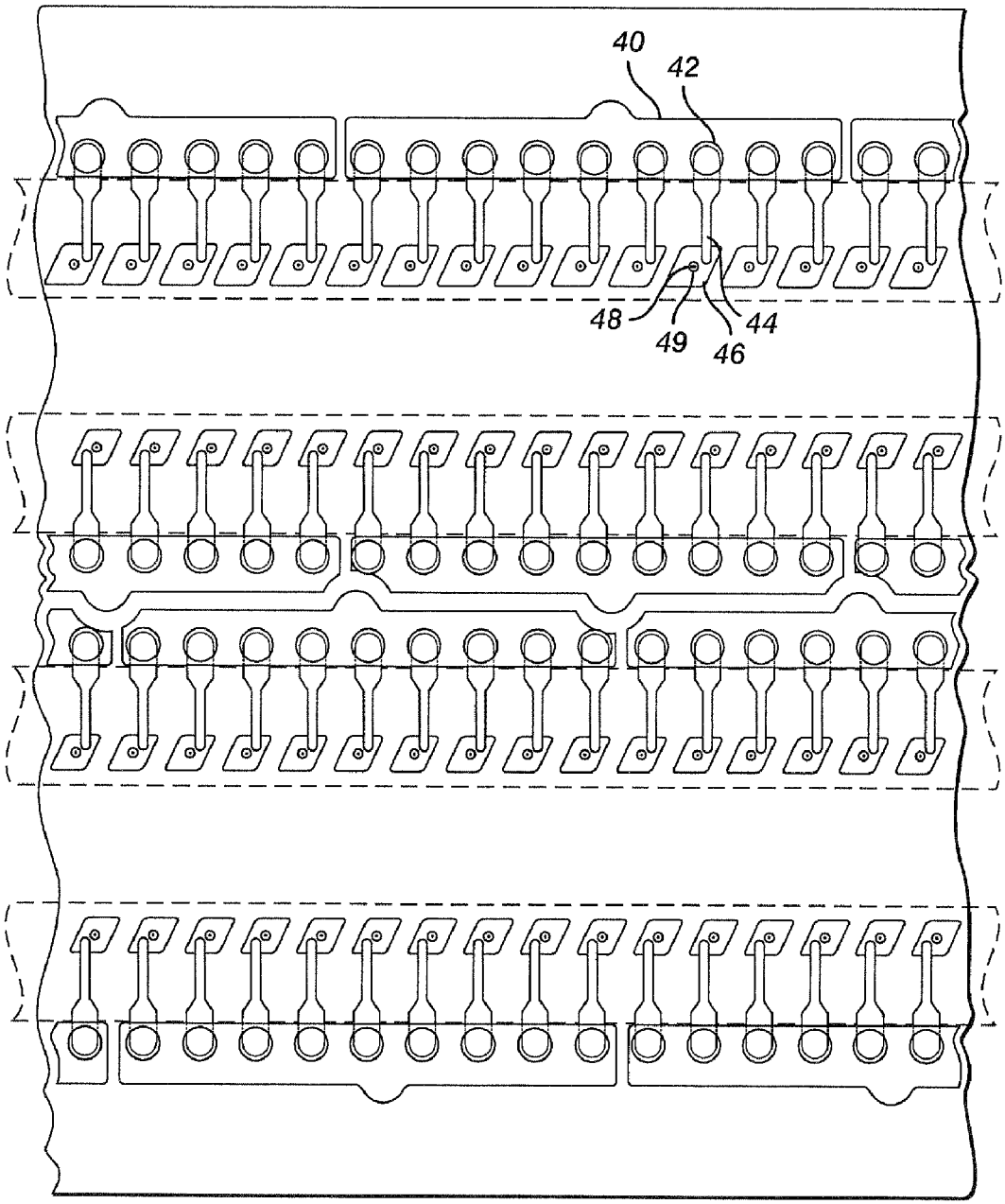
FIG. 4 shows a plan view of a jet stack having an array of jets and a pathway of the ink to the jets.
Figure 6:
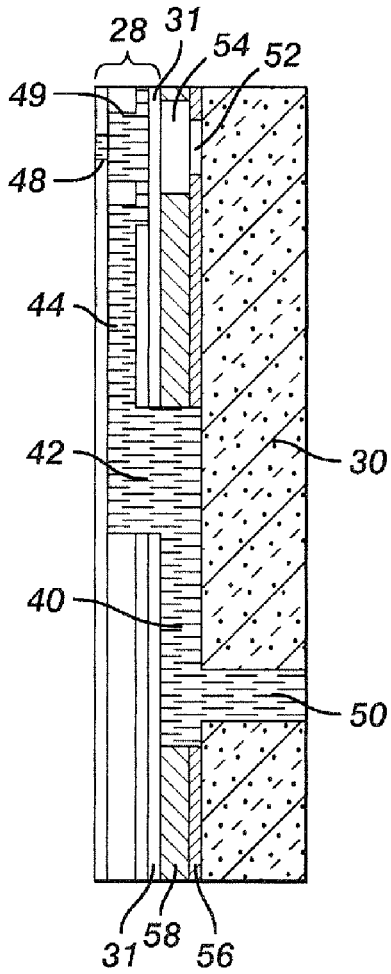
FIG. 6 shows an embodiment of a modified jet stack.

Prior to reaching the jet stack, the ink must pass through the electronic circuit board through port 50, shown in FIG. 6. It must be noted that the electronic circuit board may also consist of a flex circuit or other type of electronic circuit, but will be referred to here as an electronic circuit board for simplicity. FIG. 4 shows a plan view of the jet stack having an array of jets and the pathway of the ink to the jets. A sub-manifold such as 40 feeds a limited number of jets. Using sub-manifolds to feed a number of jets reduces the number of holes in the circuit board needed to allow the ink to pass. Several layers of sub-manifolds may be used, each progressive layer having manifolds that feed a higher number of inlets than the previous layer.

The circular or elliptical port 42 at the top of the channel feeds the ink from the sub-manifold in a separate plate through the inlet 44, which resides in another layer of the jet stack. The inlet feeds the jets, each of which has a body 46, outlet 49 and an aperture 48. The jets are organized into arrays. For the example shown, each row corresponds to a color such as cyan, magenta, yellow and black. In other examples, there may be two or more rows per color. The dotted line boxes around 44, 46, 48 and 49 indicate that these features are hidden by the other layers of the stack.

Figure 5:
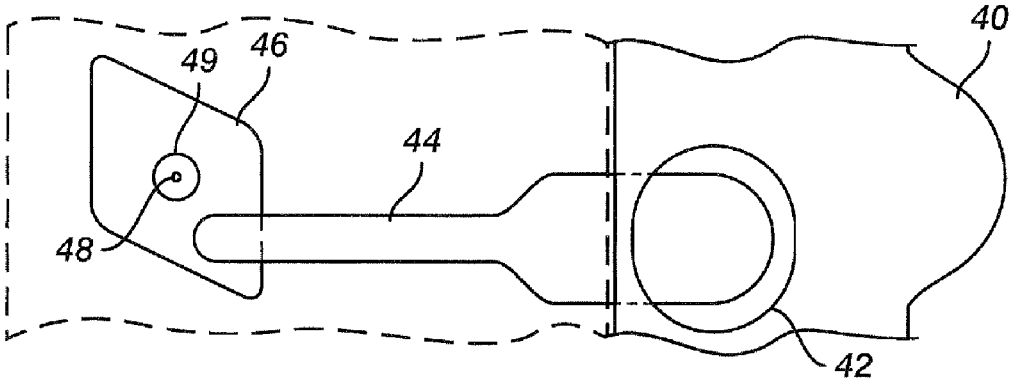
FIG. 5 shows an enlarged view of an embodiment of one jet and its corresponding portion of the jet stack.

FIG. 5 shows an enlarged view of one jet and its corresponding portion of the jet stack. The sub-manifold 40 feeds several ports, including port 42. The port 42 feeds ink through the inlet 44 and to the jet 46 having outlet 49 with aperture 48 for the actual dispensing of ink. Again, the dotted lines depict features that are hidden by other layers of the stack. The portion of the port 44 that can be viewed through the hole 42 is the only portion not hidden.

FIG. 6 shows a cross section of a modified jet stack. A first polymer layer 58 surrounds the array of transducers to form a planarized surface. A second polymer layer 56 forms a standoff that provides a path for an electrical conductor such as silver epoxy to go between the pads on the circuit board and the transducers such as 54. The transducer 54, when activated, generally vibrates or pulses or performs some other type of mechanical motion that causes the jets to push out ink.

In order to eliminate some of the plates having the internal manifolds in the jet stack, the polymer layers could be formed in such a manner as to provide the manifolds as well. FIG. 6 shows on example of this. In FIG. 6, the electronic circuit board 30 provides signaling for the transducer array. As mentioned above, the ink enters the jet stack through port 50. The polymer layer 58 provides a diaphragm such as 31, that presses forward when the transducer 54 presses against it to dispense the ink out jet 24 of FIG. 2, comprised of the outlet 49, aperture 48 and the body 44. The two polymer layers 56 and 58 may also provide passage for electrical interconnection between the electronic circuit board and the transducer array.

The polymer layers 56 and 58 also provide ink manifolds to route ink, shown by the shading, between the port 50 in the circuit board and the jet inlet 44. The ink also passes through the remaining jet stack plates 28. The ink can then flow through path 50 through the electronic circuit board and into the manifolds 40 in the polymer layers. This eliminates several of the plates that previously existed in the jet stack, increasing efficiency and reducing the possibilities of jet failure due to acoustic resonance, trapping air, etc.

Figure 7:
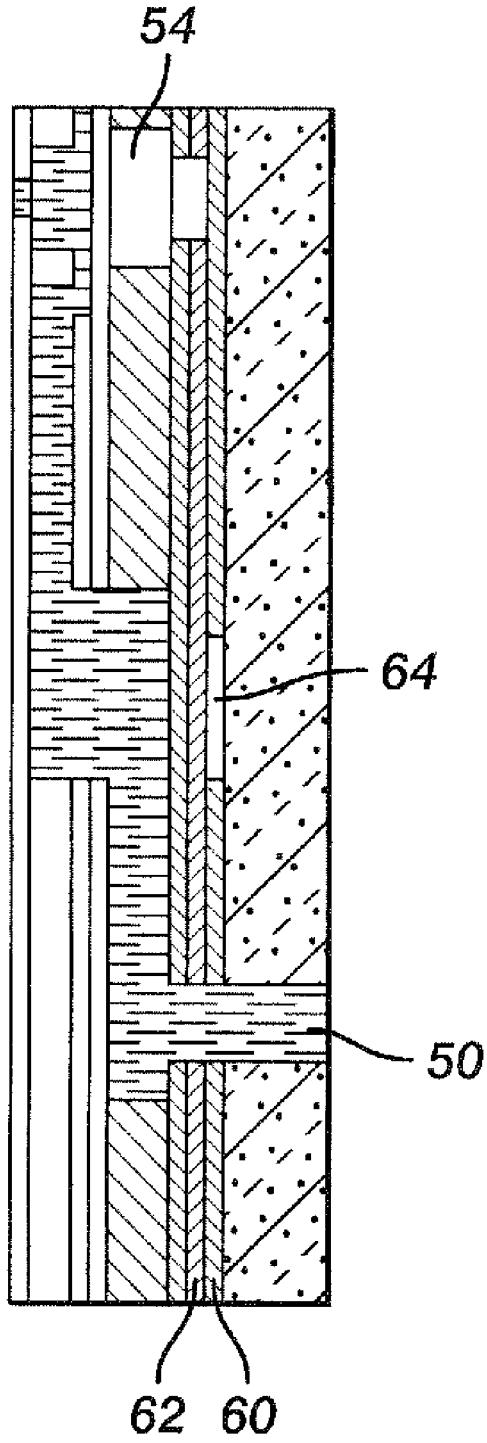
FIG. 7 shows an alternative example of a jet stack.

FIG. 7 shows an alternative example of the jet stack. In this example, there is an extra polymer layers 60 and 62. The layer 62 may form a compliant wall across the manifold region in case one desires additional acoustic damping. The additional polymer layers may also allow more design freedom for such features as air gaps, such as 64, which may allow for further flexing of the polymer layers. Air gaps may also be included in the previous examples having only two layers of polymer as well. Vents, not shown, may also be included.

Any of the features discussed above may be used in any embodiment of the print system using polymer layers for manifolds. The polymer layers may consist of polyimide, such as Kapton™ or Upilex™, known examples of polyimide. Other polymers may also be used including polyester, polysulfone, polyetheretherketone, polyphenelyene sulfide, polyethersulfone, etc. The polymer layers may bond or adhere to each other and the metal with many different kinds of adhesives including epoxy, acrylic adhesive, phenolic adhesives, other thermoset adhesives, silicone, bismaleimide or thermoplastic adhesives, etc.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A print head, comprising:

an array of jets to dispense ink onto a printing surface;

an array of actuators to cause the jets to dispense ink; and an ink manifold to route ink to the array of jets, the ink manifold being formed of more than one polymer layers.

2. The print head of claim 1, comprising one of an electronic circuit board or a flex circuit to provide signals to the array of actuators.

3. The print head of claim 2, wherein the electronic circuit board or flex circuit comprises port holes to allow ink to pass through the circuit board to the array of jets.

4. The print head of claim 1, wherein the array of actuators comprises an array of piezoelectric transducers.

5. The print head of claim 1, wherein the polymer layers are comprised of one of polyimide, polyester, polyetheretherketone, polysulfone, polyphenelyene sulfide, and polyethersulfone adhesive attached to other layers.

6. The print head of claim 5, wherein the polymer layers are attached using a bonding agent comprised of acrylic, epoxy, silicone or bismaleimide.

7. The print head of claim 1, the printhead comprising the polymer layers adhered to a jet stack, wherein the jet stack includes the array of actuators and the array of jets.

8. A print manifold comprising:

an array of jets formed on a metal plate;

at least one polymer layer mounted on the metal plate, the polymer layer including an array of manifolds corresponding to the array of jets;

an electronic circuit board mounted on the polymer layer, the electronic circuit board having an array of holes corresponding to the array of manifolds.

9. The print manifold of claim 8, wherein each hole in the array of holes corresponds to each manifold.

10. The print manifold of claim 8, wherein the at least one polymer layer comprises more than one polymer layers.

11. The print manifold of claim 10, wherein the polymer layer has an air gap.

12. The print manifold of claim 8, wherein the polymer layer is comprised of one of polyimide, polyester, polyetheretherketone, polysulfone, polyphenelyene sulfide, and polyethersulfone.

13. The print manifold of claim 8, wherein the polymer layer includes vents.

14. The print manifold of claim 8, wherein the polymer layer comprises a path for a conductive interconnect between the electronic circuit board and the jet stack.

15. A print system, comprising:

at least one ink reservoir;

at least one umbilical to transport ink out of the ink reservoir;

a print head comprising:

an electronic circuit board having ink ports to allow ink from the umbilical to pass through the electronic circuit board;

a jet stack to receive the ink and dispense it onto a printing surface;

at least one polymer layer between the jet stack and the electronic circuit board, the polymer layer to provide ink manifolds from the electronic circuit board to the jet stack.

16. The print system of claim 15, the polymer layer to provide a path to enable electrical interconnect between the electronic circuit board and the jet stack.

17. The print system of claim 15, the polymer layer including at least one air gap.

18. The print system of claim 15, the polymer layer including at least one air vent.

19. The print system of claim 15, the polymer layer further comprising one of polyimide, polyester, polyetheretherketone, polysulfone, polyphenelyene sulfide, and polyethersulfone.

* * * * *